US009797227B2

(12) United States Patent
Keller

(10) Patent No.: US 9,797,227 B2
(45) Date of Patent: Oct. 24, 2017

(54) METHOD FOR SEALING OF A BOREHOLE LINER IN AN ARTESIAN WELL

(71) Applicant: Carl E. Keller, Santa Fe, NM (US)

(72) Inventor: Carl E. Keller, Santa Fe, NM (US)

( * ) Notice: Subject to any disclaimer, the term of this patent is extended or adjusted under 35 U.S.C. 154(b) by 425 days.

(21) Appl. No.: 14/214,756

(22) Filed: Mar. 15, 2014

(65) Prior Publication Data

US 2014/0262347 A1 Sep. 18, 2014

Related U.S. Application Data

(60) Provisional application No. 61/793,548, filed on Mar. 15, 2013.

(51) Int. Cl.
*E21B 43/10* (2006.01)

(52) U.S. Cl.
CPC ..... *E21B 43/103* (2013.01)

(58) Field of Classification Search
CPC ..... E21B 43/108; E21B 43/10
See application file for complete search history.

(56) References Cited

U.S. PATENT DOCUMENTS 1,407,873 A * 2/1922 Liedbeck ..... E21B 33/14 166/285
2,626,778 A * 1/1953 Lockett ..... E21B 33/134 166/188
4,778,553 A 10/1988 Wood
5,176,207 A 1/1993 Keller
5,246,862 A 9/1993 Grey et al.
5,377,754 A 1/1995 Keller
5,803,666 A 9/1998 Keller
5,804,743 A 9/1998 Vroblesky et al.
5,853,049 A 12/1998 Keller
6,026,900 A 2/2000 Keller
6,109,828 A 8/2000 Keller
6,244,846 B1 6/2001 Keller
6,283,209 B1 9/2001 Keller
6,601,449 B1 * 8/2003 Jones ..... G01F 23/167 73/299
6,910,374 B2 6/2005 Keller
(Continued)

FOREIGN PATENT DOCUMENTS

CN 101024540 A * 8/2007 ..... C02F 3/28
CN 100436341 C * 11/2008

OTHER PUBLICATIONS

Keller, C., "Improved Spatial Resolution in Vertical and Horizontal Holes . . . "; Remediation of Hazardous Waste Contaminated Soils; 1994; pp. 513-541; Macel Dekker, Inc.; USA.
(Continued)

*Primary Examiner* — Taras P Bemko
*Assistant Examiner* — Manuel C Portocarrero
(74) *Attorney, Agent, or Firm* — Rod D. Baker

(57) ABSTRACT

A method for sealing a flexible liner that has been emplaced in a borehole manifesting artesian water flow. The upper end of the liner is closed with a plug, and a mud tube is extended from the plug down to a small volume of mud at the bottom end of the liner. The pressure in the liner interior is increased according to the weight of the mud column in the mud tube. Pressure in the liner interior can be regulated by allowing mud to move up and down in the mud tube, and by adding or withdrawing water from the closed liner interior.

17 Claims, 5 Drawing Sheets

(56) References Cited

U.S. PATENT DOCUMENTS

| | | | | |
|---|---|---|---|---|
| 7,281,422 | B2 | 10/2007 | Keller | |
| 7,753,120 | B2 | 7/2010 | Keller | |
| 7,841,405 | B2 | 11/2010 | Keller | |
| 7,896,578 | B2 | 3/2011 | Keller | |
| 8,069,715 | B2 | 12/2011 | Keller | |
| 8,176,977 | B2 | 5/2012 | Keller | |
| 8,424,377 | B2 | 4/2013 | Keller | |
| 2007/0113638 | A1* | 5/2007 | Ringgenberg ..... | G01N 1/14 73/152.23 |
| 2012/0173148 | A1 | 7/2012 | Keller | |

OTHER PUBLICATIONS

Cherry, J.A., et al.; "A New Depth-Discrete Multilevel Monitoring Approach for Fractured Rock"; Ground Water Monitoring & Remediation; 2007; pp. 57-70; vol. 27, No. 2; USA.

* cited by examiner

METHOD FOR SEALING OF A BOREHOLE LINER IN AN ARTESIAN WELL

CROSS-REFERENCE TO RELATED APPLICATIONS

This application claims the benefit of the filing of U.S. Provisional Patent App. Ser. No. 61/793,548 entitled "Method for Sealing of a Borehole Liner in an Artesian Well" filed on 15 Mar. 2013, and the specification thereof is incorporated herein by reference. This application is related to U.S. Utility patent application Ser. No. 14/205,480 entitled "Method of Installation of Flexible Borehole Liner Under Artesian Conditions" filed on 12 Mar. 2014, the specification of which is incorporated herein by reference.

BACKGROUND OF THE INVENTION

Field of the Invention

This invention relates to the development of a safe interior pressure in order to affect the seal of flexible borehole liners in boreholes in geologic formations with shallow water tables or formations exhibiting artesian hydraulic head conditions. The liner may or may not be installed in the borehole by pressurized eversion.

Background Art

A "borehole" is a hole, e.g., a drilled shaft, into the Earth's subsurface. The hydraulic conductivity profiling techniques described in my U.S. Pat. Nos. 6,910,374 and 7,281,422, whose teachings are incorporated herein by reference, have been used in over 300 boreholes since 2007. These patents describe a hydraulic transmissivity profiling technique which carefully measures the eversion of a flexible borehole liner into an open, stable, borehole.

Liners are usually installed into the open boreholes using a water level inside the liner which is significantly higher than the water table in the formation penetrated by the borehole. However, when such a desirable excess head is not available within the borehole, a scaffold and an extension of the surface casing, above the ground's surface, are often used to obtain the higher water level within the liner to achieve the pressure head needed during the installation of the liner. The continued presence of a scaffold and/or casing extension is usually an objectionable means for providing long-term pressurization of the flexible liner adequately to seal the borehole. In other situations, the inventor of the invention hereinafter disclosed has filled the liner with a weighted mud to achieve an interior pressure sufficient to seal the liner against the artesian head in the formation. In a deep borehole, however, the mud density required to seal the borehole throughout an upper portion of the hole produces such a high pressure at the bottom of the borehole as to risk bursting of the borehole liner. The present invention ameliorates or eliminates the risk of busting the liner, while yet promoting a reliable sealing of the borehole by the liner.

With the foregoing background, the presently disclosed invention was developed.

SUMMARY OF THE INVENTION

The invention described hereafter allows an installed liner (installed by eversion or otherwise) to be pressurized in a manner similar to the use of a tall casing extension above the ground surface. However, the "virtual" casing extension of the present invention is located interior to the borehole, and does not interfere with the ground surface appearance, or with the use of above-ground equipment, after the liner is installed. Furthermore, the following method and apparatus does not require the filling of the entire length/depth of liner with a weighted mud, and thus avoids the development of excessive pressures at the bottom of the liner which otherwise undesirably occurs.

There is disclosed herein a method and apparatus to maintain an elevated pressure inside a flexible liner located in a borehole, such that the liner provides a competent seal of the borehole. This method and apparatus allow the convenient pressurization of a liner in circumstances of artesian conditions or shallow water tables, where a known method, using an elevated water level inside the liner (e.g. well casing extension high above ground surface), is not possible with a particular borehole. The present method uses the gravitational force upon a heavy mud column to obtain a sufficient increase of the pressure inside the liner. The desired elevated pressure inside the liner is achieved by adding a weighted mud to an interior mud tube and sealing the top end of the liner. The heavy mud column descends under the force of gravity so as to partially fill the bottom end of the liner, and thus causes an increase in the interior pressure of the water trapped inside the liner. Only a small amount of mud fill in the bottom of the liner is needed to increase the water pressure inside the liner. Accordingly, unlike previous methods of installation of a heavy mud fill of the liner, this presently disclosed method uses primarily an ordinary water fill in a major portion of the liner's interior volume. With a water fill of the liner, excessive pressures do not develop at the bottom of the liner, which otherwise are possible with a complete mud fill of the liner. A central aspect of the invention is to seal a liner in a shallow to artesian water table situation, with the advantage of using only a small quantity of mud (a good savings) or grout (a great savings). The advantage of not having an increasing pressure, as in a tall mud column standing in the liner interior nearly to the ground surface, is a great reduction of risk of liner blow-out. Rather, a flowable mud instead sands in the narrow-diameter mud tube extending to the bottom of the installed liner. Also, the ability to adjust the liner pressure to a wide range of pressures is a great advantage.

Other advantages and devices associated with this method will be described.

BRIEF DESCRIPTION OF THE DRAWINGS

The attached drawings, which form part of this disclosure, are as follows.

DESCRIPTION OF THE INVENTION

Including the Best Mode for Practicing the Invention

Figure 1:
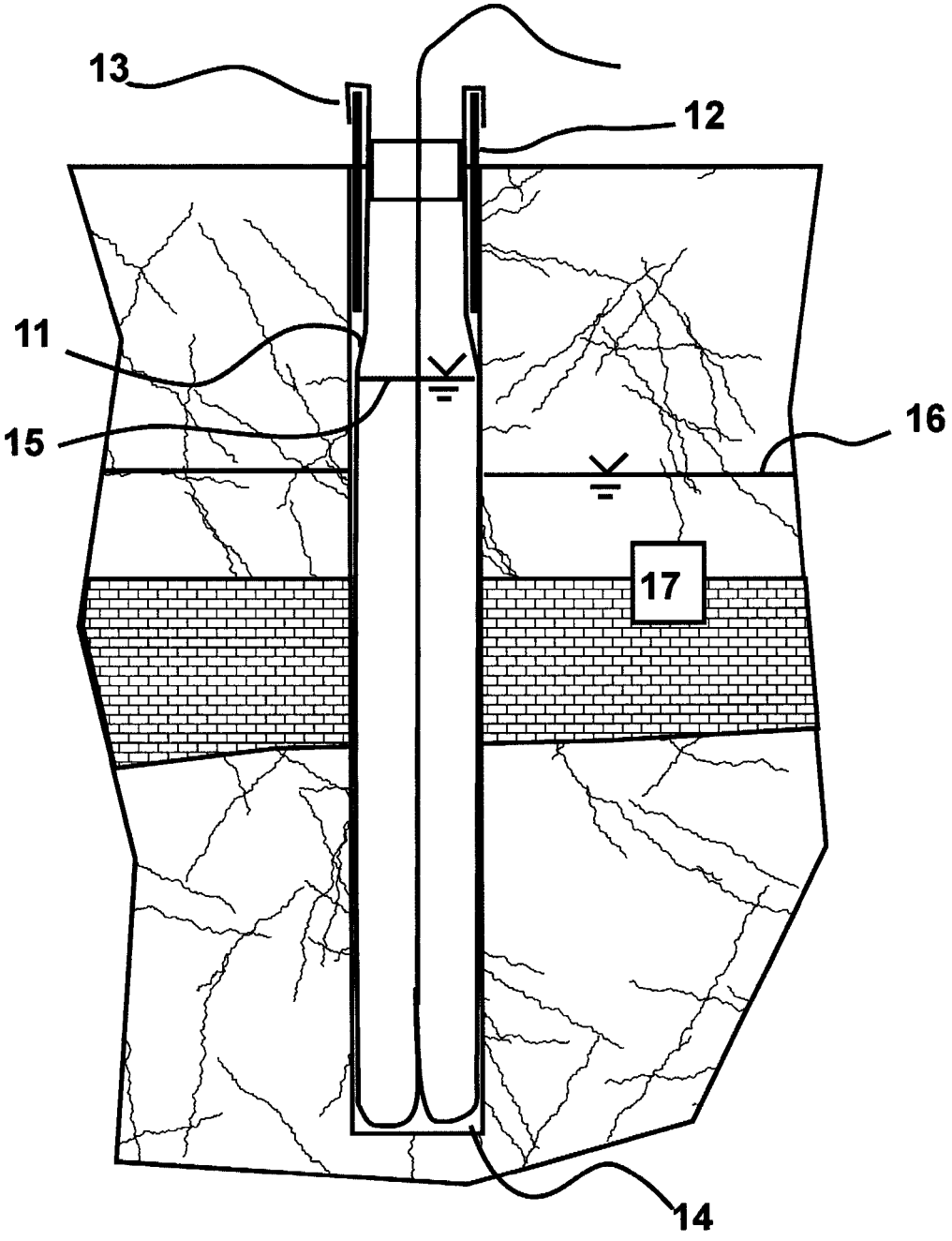
FIG. 1 is a side sectional view of a typical everting liner installation according to techniques known previously.

FIG. 1 provides an example of an everting liner installation according to the prior art. Installations of flexible liners into boreholes, by the eversion of the liners, are disclosed in previous patents, such as my U.S. Pat. Nos. 6,283,209, 6,794,127, and 7,896,578, the teachings of which are incorporated here by reference. The liner 11 has been attached to the top of the casing 12 at juncture 13. The liner 11 in the borehole 14 is filled with water to the level 15, which level is above the existing water table 16 in the subsurface geologic formation 17. As the liner 11 descends the borehole, the water beneath the liner 11 and within the borehole 14 is displaced into available flow paths in the surrounding formation 17, allowing the liner to propagate by the liner's eversion at its lower end. The driving pressure to evert the liner is generated by the difference between the pressure head in the liner (due to elevated water level 15) and the natural head in the formation 17 at the native water table 16. If the pressure head at the water table 16 in the formation is higher than the head 15 in the liner, the liner 11 collapses under the formation water pressure, and the liner cannot propagate down the borehole. Thus, a minimum head difference is needed to cause the liner 11 to deform properly during the eversion process. That minimum eversion pressure is greater for smaller borehole diameters than for larger diameter boreholes. In some situations known previously, a tube (not shown) is emplaced to the bottom of the borehole 14 to remove the water from beneath the liner 11 (i.e., between the liner's descending point of eversion and the bottom of the borehole) when the transmissivity of the formation 17 adjacent the borehole 14 is insufficient to allow the water beneath the liner to be displaced into the formation. Thus for the liner 11 to be easily everted down the borehole, the water table 16 in the open borehole must be a sufficient distance below the top of the surface casing 13 to allow a sufficient fill of the liner to drive the eversion process. For some boreholes, that minimum water table depth in the formation may be 5 feet below the top of the casing. In other situations involving smaller boreholes, a water table 20 feet below the top of the casing may be required to obtain adequate driving head for the liner.

If the water table depth in the formation 17 is less than the necessary distance below the top of the casing 13, one can extend the surface casing upward (above the surface of the ground) to obtain a higher driving pressure inside the liner. There are, however, practical safety limits as to how high the casing can be so extended, with the associated surrounding scaffolding for work space for the installation personnel. Casing extensions for this purpose are cumbersome and to be avoided when possible.

Figure 2:
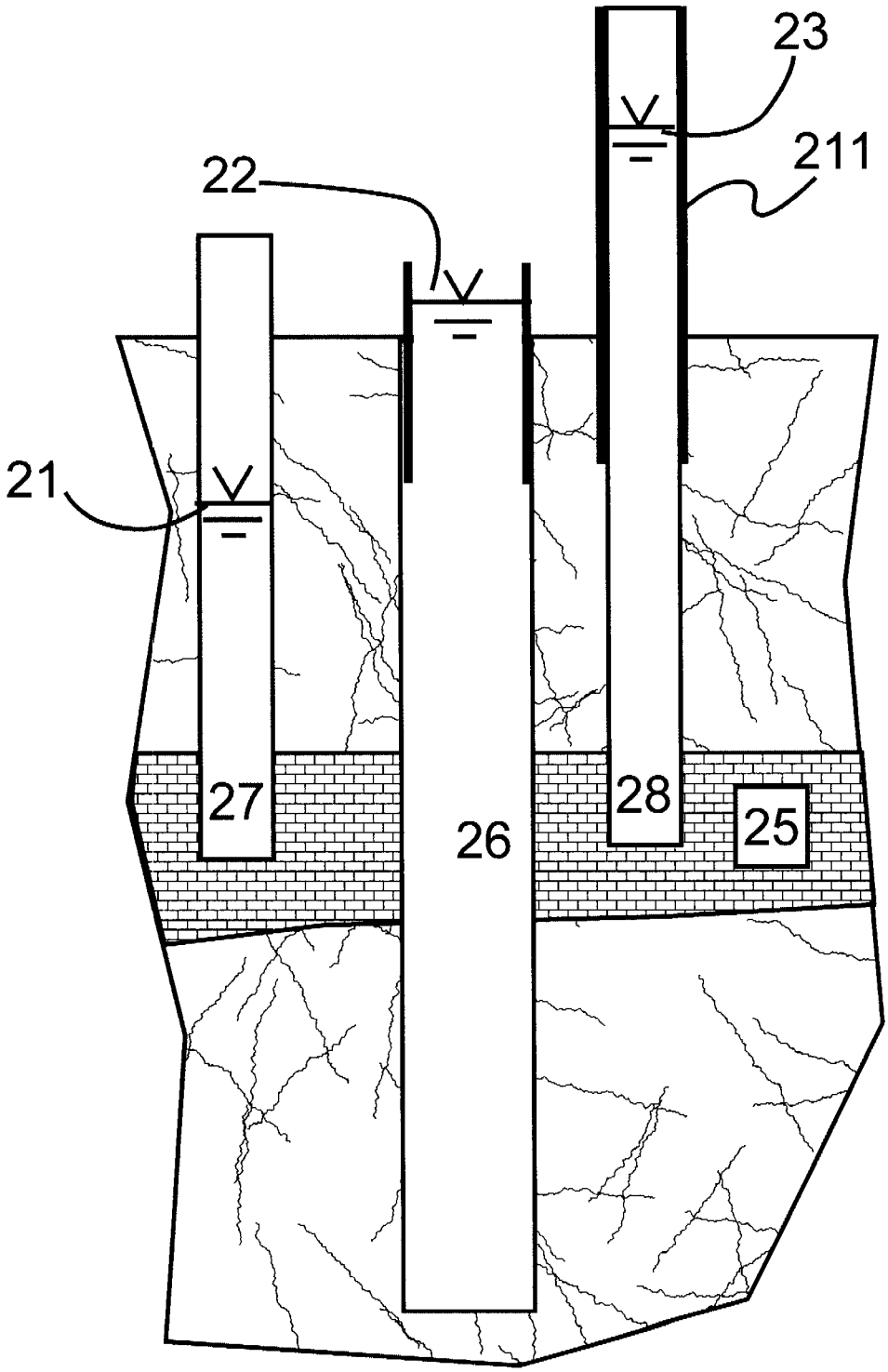
FIG. 2 is a side sectional view of three examples of water table conditions of increasing difficulties addressed by the present invention.

FIG. 2 illustrates several static water tables as may be seen in three hypothetical casings 26, 27, 28 extending into a geologic formation 25. In a commonly encountered circumstance, the water table level 21 is in the borehole 27 some significant distance below the surface. A more troublesome situation is when the natural level 22 is near the surface just below the top end of casing 210, as seen in the middle borehole of FIG. 2. The worst case for installing everting liners, seen in the borehole 28 on the right side of FIG. 2, is when the level 23 of the water table in the formation intersected by the borehole 28 is far above the ground's surface. In the latter case, if the height of the casing 211 were below the level 23, the water from the subsurface formation(s) 25 would flow over the top of the casing 28 onto the surface of the ground. If natural level 23 is very high above the surface, and the transmissivity of the formation 25 is a large value, the flow rate out of the top of the (too-short) casing can be large. Such artesian flows are normally undesirable for the everting liner installation.

In the borehole 27 seen on the left side of FIG. 2, where the natural water level 21 is a significant distance below the surface of the ground, a typical liner installation can be effected by known techniques, as discussed above with reference to FIG. 1. In the circumstance of the middle borehole 26 in FIG. 2, with the water level 22 near the surface, a casing extension is needed. In the third situation seen in the right borehole of FIG. 2, an everting liner installation normally would not be attempted—a circumstance addressed by the techniques of the present disclosure.

The invention described in my co-pending Utility Patent Application Ser. No. 14/205,480, filed on 12 Mar. 2014, and entitled "Method of Installation of Flexible Borehole Liner Under Artesian Conditions,"allows a liner to be everted into a borehole with a very high artesian water table. Whereas that apparatus and method is most useful in allowing a liner to be installed with a very elevated water level 23 (right side of FIG. 2 herein), that invention also allows installation in the situation of a manageable water level 22 (middle example of FIG. 2 herein) without scaffolding or with a minimum casing extension; it is therefore preferable to the current practice due to safety concerns about tall scaffolding and the inconvenience of installers working on scaffolding. Also, some installations in roadways or parks do not allow a permanent extension of the casing above the surface in order to obtain a sealing liner pressure. However, once the liner installation has been effected, the liner still needs to be suitably inflated to seal the borehole.

The present disclosure does not assert that the use of a heavy mud for installing liners is an innovation in itself worthy of patent protection. Such practice has been in use for many years in order to obtain a sufficient excess head in the liner to seal the borehole with the liner water level such as level 22 seen in FIG. 2. Rather, the present invention is a combination of components and processes allowing the use of flexible liners to seal a boreholes under conditions that would normally prohibit the effective sealing of the borehole without the use of a long (vertical) stand pipe high above the ground's surface, or a heavy mud fill of the entire liner.

Figure 5:
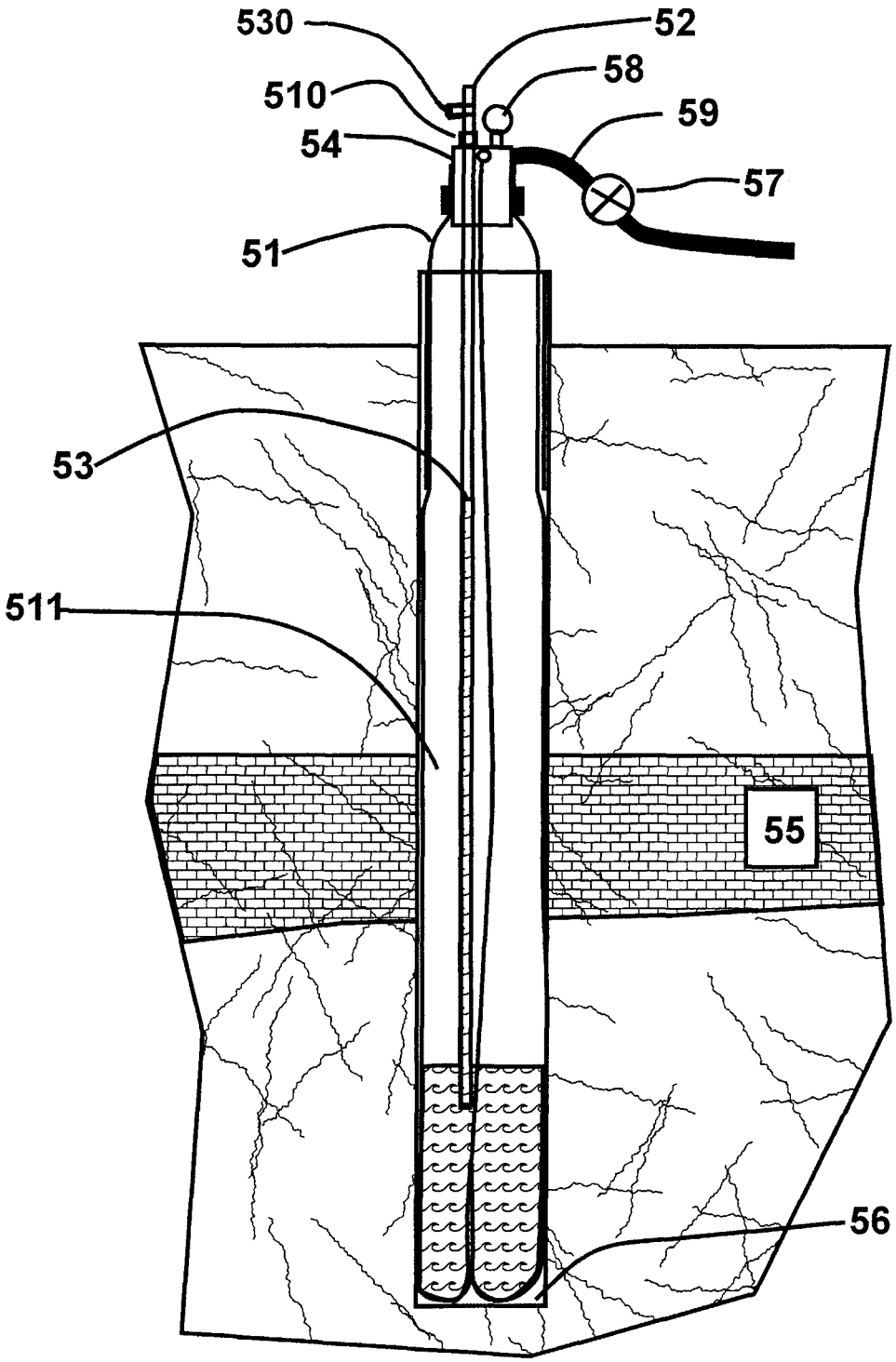
FIG. 5 is a diagrammatic side view, in partial section, of an apparatus and method according to the present invention showing inflation of the liner with a water addition in accordance with the present invention.

Reference is invited to FIG. 5, which introduces some of the features of the present invention, including the apparatus installation completed with elements as follows: The flexible liner 51, the mud pipe 52, the partial mud fill 53, and the sealed top end 54 of the liner 51. Also significant to the convenience of the method and apparatus are the pressure relief hose 59 with valve 57, and the pressure gauge 58. The liner 51 has been installed to the bottom of the borehole 56. The procedure for producing a sufficient, long term, nearly uniform pressure inside the liner is described hereafter. The procedure will be described for a simple impermeable flexible liner without any attachments or other devices. However the method can be used for the more complex liner systems described in other patents such as U.S. Pat. Nos. 6,283,209 and 7,896,578.

Figure 3:
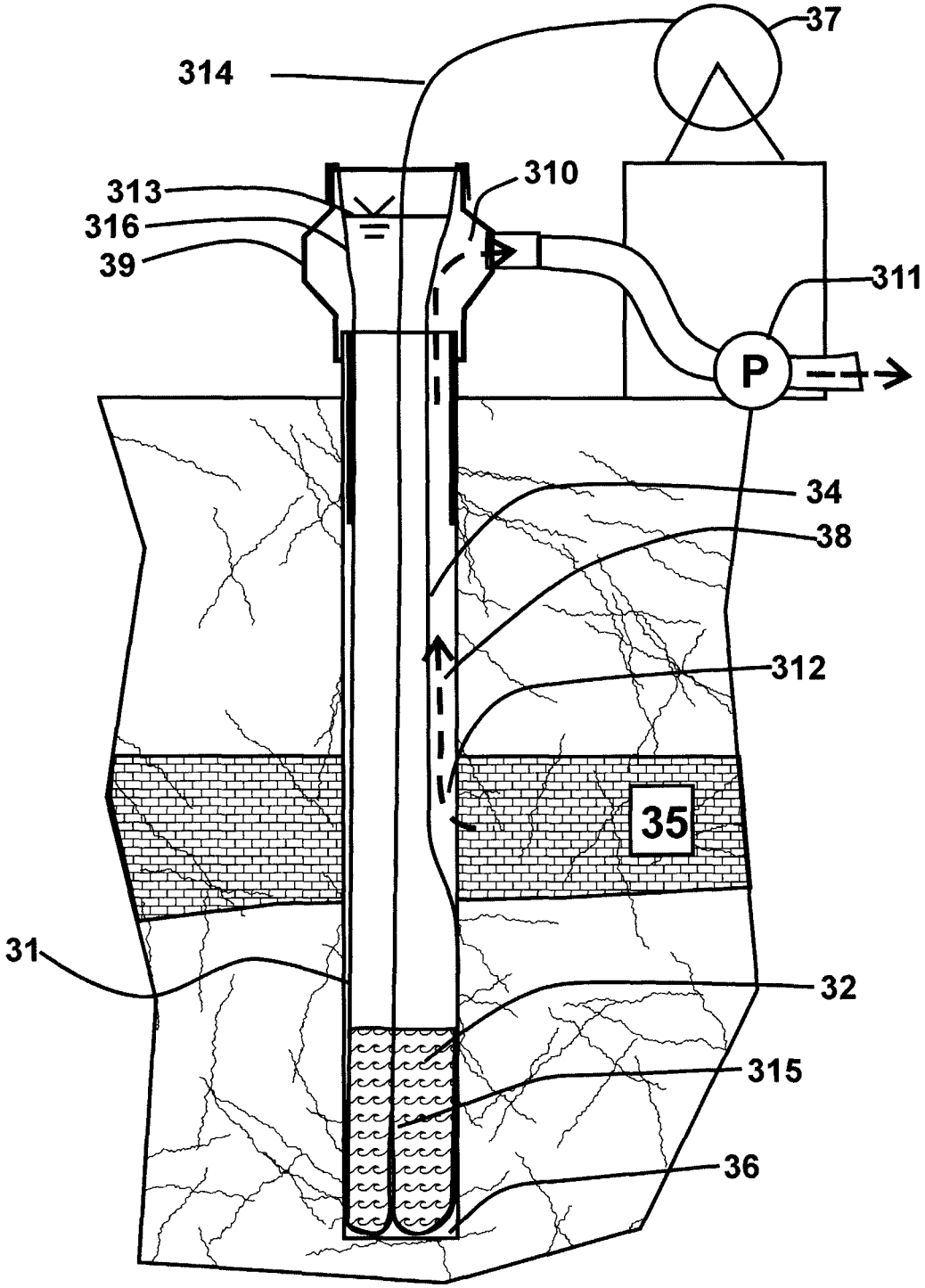
FIG. 3 is a diagrammatic side view, in partial section, of an apparatus and method according to the present invention, showing the installation of a liner to the bottom of a borehole with a small amount of mud fill.

There now is provided disclosure of process and procedure for installing and sealing an everting liner to obtain the configuration depicted in FIG. 5. Details of a possible installation procedure are the subject of patent application Ser. No. 14/205,480 cited above. The liner 31 may be deployed from the reel 37 (FIG. 3) at the surface, through a special wellhead design 39 described in the co-pending patent application Ser. No. 14/205,480. The top portion of the wellhead assembly 39 and pump 311 (seen in FIG. 3) are removed to allow the top open end of the liner 31 to be suitably sealed. FIG. 3 illustrates that the liner 31 has been installed into the borehole 36. A modest volume of weighted mud 32 is placed in the liner interior, if it was not already emplaced as part of the installation procedure. This small volume amount of weighted mud 32 placed in the bottom (everting) end of the liner can induce eversion of the liner down the borehole 36 with no direct concern for the artesian water table of the formation 35. A suitable tether 314 of strong cord extends from the surface, and is attached to the inverted bottom end 315 of the liner 31, which may be at the very bottom of the borehole 36.

There next follows a step of partially filling the liner interior, above the volume of weighted mud, with water; the upper portion of the liner, above the small volume of mud 32, is filled with water (e.g., to the level 313). In FIG. 3, the upper end of the liner 34 is open, but it subsequently is sealed with a plug. The upper liner portion 34 above the mud fill 32 is shown as partially collapsed by the artesian water flow 312 from the nearby geologic formation 35, as the artesian pressure exceeds the water pressure in the liner interior. At this stage of the practice of the invention, water ordinarily flows under artesian pressure from the formation 35, up an intermediate length 38 of the borehole (e.g., between the liner portion 34 and the hole wall), and toward the surface. During this time, that water 312 is allowed to flow out of the special wellhead 39 at draw-off location 310 (where a pump 311 connected to the wellhead fixture 39 draws off the water). In such condition and circumstance, it is difficult to dilate the liner 31, especially upper portions 34, to provide a reliable seal of the borehole.

Figure 4:
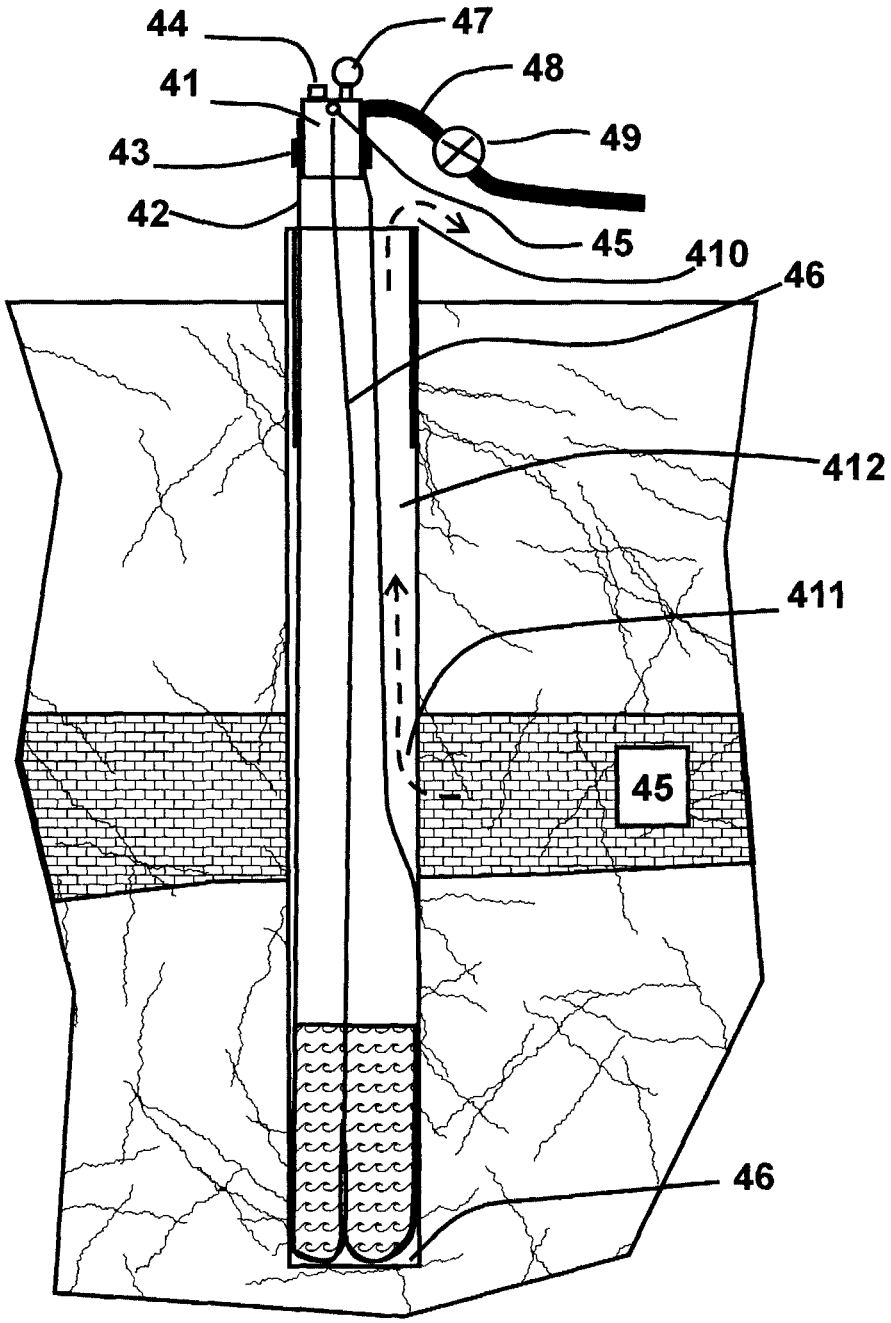
FIG. 4 is a diagrammatic side view, in partial section, of an apparatus and method according to the present invention, showing the attachment of a sealing device to the top open end of the liner, and with the liner partially collapsed by the artesian head.

FIG. 4 shows how according to the present apparatus and method the wellhead assembly 39 has been removed to allow for a step of sealing with a plug an upper end of the liner. A sealing plug 41 is installed into and within the top end of the liner 42. The outside of the liner 42 is clamped tightly with a suitable clamp 43 to seal the contact between plug 41 and liner. The sealing plug 41 contains a compression fitting 44, an eye bolt 45 for connection of the tether 46 (314 in FIG. 3) to the inside bottom of the plug, a pressure gauge 47 (e.g., at the sealing plug 41 for measuring pressure in the liner below the plug), and a hose connection 48 with a valve 49 on the hose 48. At this point in the procedure, the artesian flow 411, originating from the subsurface formation 45, is still allowed to flow upward past an upper portion of the liner 412 and then over the top of the casing at location 410.

Attention is invited to FIG. 5. Following the conditions of FIG. 4, there are performed the steps of installing a mud tube through the plug and extending the tube in the liner interior between the plug and the volume of weighted mud. As seen in FIG. 5, a mud tube 52 is installed into the liner interior 511 via a compression fitting 510 through the sealing plug 54 (i.e., corresponding to sealing plug 41 in FIG. 4). The compression fitting 510 is tightened about the tube 52; as a result the liner interior is now completely sealed. There optionally but preferably is provided in the mud tube 52 a check valve 530, such as a duck-bill valve, for which allows air to enter the top end of the mud tube, but which prevents any fluids from exiting out of the top of the tube. The one-way check valve 530 is above the plug 54. The top of the tube 52 thus preferably sealed with valve 530 against the exit of fluids to permit increase in pressure therein.

Water is added into the liner interior 511 between the plug and the volume of weighted mud. A hose 59 connection into the sealing plug 54 allows water to be added to the interior 511 of the liner 51, and the interior of the liner (above the small volume of mud 32 placed at the liner bottom 315 earlier in the process (FIG. 3)) is at least partially filled with water. A valve 57 on the hose 59 allows the hose to be sealed closed after the liner 51 has been fully dilated with a low pressure water fill through the hose and plug 54. With a low-pressure water fill of the interior 511 of the liner 51, the borehole is sealed, as the liner is dilated and pressed toward the wall of the borehole. The pressure in the interior 511 of the liner 51 is monitored with the pressure gauge 58 in and through the top of the sealing plug 54.

The steps of the method of the invention include at least partially filling the mud tube with a flowable mud. The mud tube 52, which penetrates the plug 54 and extends into the liner interior 511, is then filled partially or entirely with a heavy mud 53 delivered from any suitable container at the top end of the tube 52 (i.e., at the ground's surface). As depicted in FIG. 5, the mud tube 52 extends from the plug 54 to the small volume of mud (32 in FIG. 3) placed previously at the liner bottom 315. The mud 53 is mixed to obtain a sufficient density and viscosity such that the mud flows by gravity in the tube 52 to the bottom of the liner 51, adding to the original shallow mud fill (mud 32 in FIG. 3).

The mud tube 52 is at least partially filled with a flowable mud; any mud added into the mud tube increases the pressure inside the liner, as a result of the liner interior 511 being plugged closed (unless deliberately opened at the plug 54 to permit venting of the interior). Because the liner 51 is sealed, the addition of mud 53 via mud tube 52 increases the pressure of the water fill in the liner interior 511, until the water pressure is sufficiently high to prevent any further descent of the heavy mud 53 in the tube 52.

The pressure in the liner interior 511 can be regulated and adjusted by adding or removing water to or from the closed liner interior, by means of the valve 57 and hose 59. If the pressure within the liner interior 511 exceeds a desired value, water can be removed; the valve 57 is opened to permit some water to flow from the liner interior (via a passage through the plug 54) until the mud column 53 descends in the tube 52 to provide the desired pressure within the liner. At that time, the valve 57 is closed, and the water pressure within the liner is higher than the pressure head in the formation 55, causing the liner 51 to press sufficiently against the borehole wall to seal reliably the borehole. Due to the gravitational force on the mud 53 in the mud column, which is of significantly higher density than the water inside liner, the desired pressure is maintained in the interior 511 of the impermeable liner interior 51.

If there is any subsequent small amount of water leakage from within the liner, the mud column 53 in tube 52 descends to maintain a slightly lower pressure in the liner. This is a significant advantage of the mud 53 column standing in the tube 52. In previous attempts to maintain a constant pressure in liner interior 511 with the addition of air through a sealing plug, the air diffused through the liner 51, or dissolved in the water within the liner, and the liner pressure dropped below the minimum level needed to provide a reliable seal of the borehole by the liner.

The mud-filled tube 52 maintains the pressure within the liner needed to dilate the liner against the borehole wall. Accordingly, there is no need for a tall stand pipe or casing extension above the ground's surface to provide the necessary long term pressurization of the liner under circumstances of artesian pressure in the formation 55. It is much easier to seal the liner 51 against water leakage than against air leakage. The elimination of a standpipe above the surface casing of the borehole is an advantage of the present apparatus and method.

An important aspect of this system and method is that the water column throughout the length/depth of the liner interior 511 has a constant excess head over the ambient formation pressure. If the heavy mud were used to fill the entire liner, the over pressure in the liner would be a function of the depth of the mud in the liner. In that case, the overpressure in the liner would be:

$$\Delta P=(\rho-1)D$$

where ρ is the density of the mud and D is the depth below the surface of the mud in the liner. For deep boreholes, the excess pressure inside the mud filled liner may exceed the burst pressure of the liner. In the current system and method, the only mud contacting the inside of the liner is the small amount of weighted mud 32 disposed in the bottom end 315 of the liner (FIG. 3). The remainder of the water-filled liner above the weighted mud 32 has a constant excess pressure. This feature greatly reduces the risk of exceeding the burst pressure of the liner. Another advantage of the system is that if the liner is to be retracted by inversion from the borehole at a later time, the amount of mud to be removed as the liner is inverted from the borehole is far less than if the entire liner were mud-filled. Since the mud is much more expensive than water, the limited mud fill of the liner is also a reduction in the cost of the emplacement.

A typical mud used for this method may be a mix of a clay (such as bentonite) and a powdered, high density mineral such as barium sulfate, which has a grain density of 4.1 gm/cc. The heavy barite powder and bentonite mix remains plastic and the bentonite forms a gel which prevents the settlement of the powdered mineral. It has been observed that without the thixotropic property of the clay mineral, the heavy powder settles over a long time and forms a mass of high shear strength, which can prevent the inversion of the liner for its convenient removal from the borehole. The mud mixture must have a sufficient gel strength for support of the weighting material, but also must exhibit sufficiently low shear strength so as to allow the mud to flow in the mud tube, as needed, to maintain the pressure in the liner. While significant to the practice of the present invention, these mud properties are of common determination, selection and use in the drilling industry. Tests of mud mixtures provided data on the mud properties meeting the needs of the present system and method. It is possible to support the weighting material, and still allow the mud to move in the mud tube, with approximately 1.0 psi change in the liner pressure. The diameter of the mud tube 52 can also be adjusted to allow favorable mud behavior. The larger the mud tube diameter, the more easily the mud 53 can flowably move up/down in the tube to accommodate pressure changes in the liner.

Although the weighted mud 53 described is a common suitably heavy liquid, any suitable heavy liquid can be used in the practice of this invention instead of the mud. Thus in this disclosure and the claims, "mud" refers to any suitable heavy liquid. Common muds are somewhat erratic in their properties of the mixture due to pH and water quality effects. Attractive alternative options for a heavy liquid in lieu of heavy mud are polymer mixtures such as are used in drilling oil wells.

Another attractive feature of the present invention is that the pressure in the mud tube 52 can be increased by application of air pressure at the top of the mud tube (FIG. 5). The mud tube is much easier to seal against air leakage than the seal between the top plug 54 and the liner 51. In each of these variations, the pressure in the liner interior 511 is easily adjusted by pumping water into, or removing it from, the liner via the hose 59 (FIG. 5). The application of air pressure to the top of the tube 52 is also useful for increasing the liner interior pressure even if the tube 52 is only filled with water.

The filling of the mud 53 in the tube 52 can be effectuated by pressurizing the liner interior with water by means of the water addition hose 59 and valve 57. The increased liner interior pressure will force mud upward in the tube until it reaches a level whereby the mud column pressure (of the tube 52) equals the pressure in the liner interior 511. In a like manner, if the tube 52 is sealed at the top and filled partially with air and/or partially with water, an increase of the liner pressure will raise the mud or water level in the tube until it compresses the air to achieve a water pressure in the tube in equilibrium with the pressure of the liner interior. Any subsequent change in the liner pressure will be offset by an expansion or contraction of the volume of air trapped in the upper portion of the sealed tube 52. With these several mechanisms, a liner interior pressure change is moderated in the event of any liner leakage, or other cause for a pressure change in the liner interior.

It is common for the artesian pressure in the formation 55 to increase after a rain storm. Such an increase could collapse an ordinary liner filled with mud or water when the top of the liner is not sealed. The liner collapse can lead to loss of the liner seal of the borehole. However, with the sealed liner of this design, an increase in the artesian pressure also causes an increase in the liner interior pressure. This is because the liner 51 is elastic, such that an increase in the formation's artesian pressure decreases the differential pressure across the liner. That decrease causes the liner to contract, and thereby increases correspondingly the internal pressure of the liner. The space for accommodating the liner volume change is the usual breakouts and other voids in the wall of the borehole adjacent the liner. The elasticity of the normal liner made of a nylon fabric is very useful for this beneficial behavior. This compensating effect is best if the tube 52 is filled to its top with water or mud, and sealed. However, in order to allow the fill of the mud tube to descend in the event of a decrease of the liner pressure, a one-way check valve should be located in the sealed end to allow air to enter but prevent fluid flow out of the top of the mud tube.

Where the present disclosure shows a means and method of maintaining a constant over-pressure inside a blank liner, the same method can maintain the pressure desired inside of other types of flexible borehole liners.

Accordingly, there is disclosed a method for sealing a flexible liner 51 disposed in a borehole 56 having a wall, comprising the basic steps of: placing a volume of weighted mud 32 at a lower portion 315 of the liner interior 511; at least partially filling the liner interior, above the volume of weighted mud, with water; sealing with a plug 54 an upper end of the liner 51;

installing a mud tube 52 through the plug 54 and extending the mud tube in the liner interior 51 between the plug 54 and the volume of weighted mud 32; and at least partially filling, to a first level, the mud tube 52 with a heavy flowable mud to increase a pressure in the liner interior 511. Adding water into the liner interior 511 preferably includes providing a tube or hose means for withdrawing water through the plug, and further comprising regulating the pressure in the liner interior by controlling with a valve 57 a flow of water from the liner interior. The method also includes the steps of adding water into the liner interior 511 to increase further the pressure in the liner interior, and displacing upward, with the increased pressure in the liner interior, the flowable mud 32 to a second level in the mud tube 52, thereby maintaining the increased pressure in the liner interior.

Also according to the invention, pressure in the mud tube 52 is increased by applying air pressure at the top of the mud tube. Preferably there is disposed a check valve 530 in the mud tube 52 for maintaining increased pressure in the mud tube. Adding water into the lining interior 511 may be done to replace any water loss from the liner interior, to increase to the first level a height of the mud 32 in the mud tube. The method also features (1) filling the mud tube 52, above the flowable mud in the mud tube and up to a top of the mud tube, with water, and then (2) sealing a top of the mud tube, thereby limiting displacement (especially upward) of the mud within the mud tube. The sealing of the top of the mud tube 52 may include disposing the check valve 530 in the mud tube 52 to allow air to flow into the tube but to prevent fluid flow, including mud or water, from the top of the mud tube.

Only some embodiments of the invention and but a few examples of its versatility are described in the present disclosure. It is understood that the invention is capable of use in various other combinations and is capable of changes or modifications within the scope of the inventive concept as expressed herein. Modifications of the invention will be obvious to those skilled in the art and it is intended to cover in the appended claims all such modifications and equivalents.

I claim:

1. A method for sealing a flexible liner disposed in a borehole having a wall, comprising:
- placing a volume of weighted mud in a liner interior;
- at least partially filling the liner interior, above the volume of weighted mud, with water;
- sealing with a plug an upper end of the liner;
- installing a mud tube through the plug and extending the mud tube in the liner interior between the plug and the volume of weighted mud;
- adding water into the liner interior, between the plug and the volume of weighted mud, to dilate the liner toward the borehole wall;
- at least partially filling the mud tube with a flowable mud; and
- moderating a pressure in the liner interior by:
  - sealing a top of the mud tube;
  - filling the mud tube partially with water;
  - trapping a volume of air in an upper portion of the sealed mud tube; and
  - allowing changes in the pressure in the liner interior to be offset by an expansion or a contraction of the volume of the air trapped in the upper portion of the sealed mud tube.

2. The method of claim 1 wherein adding water into the liner interior comprises providing tube or hose means for adding or withdrawing water through the plug.

3. The method of claim 2 further comprising regulating the pressure in the liner interior by adding or withdrawing water to or from the liner interior.

4. The method of claim 3 wherein regulating pressure comprises opening or closing a valve in the tube or hose means.

5. The method of claim 3 further comprising increasing the pressure in the liner interior above an artesian pressure in a formation to seal reliably the borehole.

6. The method of claim 3 further comprising further regulating the pressure in the liner interior by:
- withdrawing water from the liner interior; and
- permitting flowable mud to descend in the mud tube.

7. The method of claim 1 further comprising adding additional flowable mud into the mud tube to increase the pressure in the liner interior.

8. The method of claim 7 further comprising maintaining, with the weight of the mud in the mud tube, the pressure in the liner interior.

9. The method of claim 8 further comprising maintaining, in the water in the liner interior, a constant pressure head in excess of an artesian pressure.

10. The method of claim 7 wherein adding additional flowable mud comprises increasing a pressure in the liner interior by adding water into the liner interior, thereby forcing some of the volume of weighted mud upward in the mud tube until a column pressure in the mud tube equals the pressure in the liner interior.

11. The method of claim 1 further comprising increasing pressure in the mud tube by applying air pressure at a top of the mud tube.

12. A method for sealing a flexible liner disposed in a borehole having a wall, comprising:
- placing a volume of weighted mud at a lower portion of a liner interior;
- at least partially filling the liner interior, above the volume of weighted mud, with water;
- sealing with a plug an upper end of the liner;
- installing a mud tube through the plug and extending the mud tube in the liner interior between the plug and the volume of weighted mud; and
- at least partially filling, to a first level, the mud tube with a heavy flowable mud to increase a pressure in the liner interior;
- adding water into the liner interior to increase further the pressure in the liner interior;
- displacing upward, with the increased pressure, the flowable mud to a second level in the mud tube, thereby maintaining the increased pressure in the liner interior;

wherein adding water into the liner interior further comprises providing tube or hose means for withdrawing water through the plug, and further comprising regulating the pressure in the liner interior by controlling with a valve a flow of water from the liner interior.

13. The method of claim 12 further comprising increasing pressure in the mud tube by applying air pressure at a top of the mud tube.

14. The method of claim 13 disposing a check valve in the mud tube for maintaining the increased pressure in the mud tube.

15. The method of claim 12 wherein adding water into the lining interior comprises replacing a water loss from the liner interior to increase to the first level a height of the mud in the mud tube.

16. The method of claim 12 further comprising:
- filling the mud tube, above the flowable mud and to a top of the mud tube, with water; and
- sealing a top of the mud tube, thereby limiting displacement of the mud within the mud tube.

17. The method of claim 16 wherein sealing the top of the mud tube comprises disposing a check valve in the mud tube to allow air to flow into the tube and to prevent fluid flow from the top of the mud tube.

* * * * *